US011267250B2

(12) United States Patent
Miravet Jimenez et al.

(10) Patent No.: US 11,267,250 B2
(45) Date of Patent: Mar. 8, 2022

(54) BUFFER RESERVOIRS

(71) Applicant: Hewlett-Packard Development Company, L.P., Houston, TX (US)

(72) Inventors: Joan Albert Miravet Jimenez, Sant Cugat del Valles (ES); Albert Crespi Serrano, Sant Cugat del Valles (ES); Aleix Fort Filgueira, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 812 days.

(21) Appl. No.: 16/074,322

(22) PCT Filed: May 26, 2016

(86) PCT No.: PCT/US2016/034295
§ 371 (c)(1),
(2) Date: Jul. 31, 2018

(87) PCT Pub. No.: WO2017/204808
PCT Pub. Date: Nov. 30, 2017

(65) Prior Publication Data
US 2021/0187956 A1 Jun. 24, 2021

(51) Int. Cl.
*B41J 2/175* (2006.01)

(52) U.S. Cl.
CPC ..... *B41J 2/17513* (2013.01); *B41J 2/17523* (2013.01); *B41J 2/17553* (2013.01); *B41J 2/17596* (2013.01); *B41J 2002/17516* (2013.01)

(58) Field of Classification Search
CPC .... B41J 2/16526; B41J 2/175; B41J 2/17509; B41J 2/17516; B41J 2/17523; B41J 2/17553; B41J 2/17556; B41J 2/17593; B41J 2/17596; B41J 2/195
See application file for complete search history.

(56) References Cited

U.S. PATENT DOCUMENTS 4,437,104 A * 3/1984 Hudson ..... B41J 2/1721 347/36
4,558,326 A 12/1985 Kimura
6,010,210 A * 1/2000 Wilson ..... B41J 2/17503 347/7
6,030,074 A 2/2000 Barinaga
6,164,743 A * 12/2000 Hmelar ..... B41J 2/17509 347/7
6,582,068 B2 * 6/2003 Ishizawa ..... B41J 2/175 347/85
7,347,540 B2 3/2008 Piock et al.
(Continued)

FOREIGN PATENT DOCUMENTS

CN 102046389 5/2011
CN 102612445 7/2012
(Continued)

*Primary Examiner* — Anh T Vo
(74) *Attorney, Agent, or Firm* — HP Inc. Patent Department

(57) ABSTRACT

In an example, a pressure system includes a fluid movement device, a buffer reservoir coupled to the fluid movement device, and a first fluid interface coupled to the buffer reservoir. In that example, the first fluid interface is able to couple to a pressurizable chamber of a print fluid container (that can apply force on a print fluid bag of the print fluid container).

19 Claims, 4 Drawing Sheets

(56) References Cited

U.S. PATENT DOCUMENTS

| | | | | |
|---|---|---|---|---|
| 7,484,837 | B2 * | 2/2009 | Koga | B41J 2/17509 347/85 |
| 7,517,032 | B2 | 4/2009 | Nottelman et al. | |
| 7,758,174 | B2 * | 7/2010 | Karppinen | B41J 2/16526 347/85 |
| 7,997,670 | B2 | 8/2011 | Taira et al. | |
| 8,740,324 | B2 | 6/2014 | Kikuchi et al. | |
| 8,899,733 | B2 | 12/2014 | Kader et al. | |
| 8,926,077 | B2 | 1/2015 | LaCaze et al. | |
| 2005/0128231 | A1 | 6/2005 | Talon et al. | |
| 2005/0157115 | A1 | 7/2005 | Silverbrook et al. | |
| 2011/0063346 | A1 | 3/2011 | Lewis et al. | |
| 2014/0360596 | A1 | 12/2014 | Tsukahara et al. | |

FOREIGN PATENT DOCUMENTS

| | | |
|---|---|---|
| EP | 1188568 | 3/2002 |
| WO | WO-2004113079 | 12/2004 |
| WO | WO-2009144040 | 3/2009 |
| WO | WO-2012137522 | 10/2012 |

* cited by examiner

BUFFER RESERVOIRS

BACKGROUND

A printing device may include a print fluid delivery system for placing print fluid in particular locations via print head, such as on specified locations on a print medium. A printing device that uses print fluid containers including bags of print fluid may use a pressure system to apply pressure on the print fluid bag to assist the print fluid delivery system.

DETAILED DESCRIPTION

In the following description and figures, some example implementations of printing apparatus, pressure systems, and delivery systems are described. In examples described herein, a "printing device" may be a device to print content on a physical medium (e.g., paper or a layer of powder-based build material, etc.) with a printing fluid (e.g., ink). For example, the printing device may be a wide-format printing device that prints latex-based print fluid on a print medium, such as a print medium that is size A2 or larger. In the case of printing on a layer of powder-based build material, the printing device may utilize the deposition of printing fluids in a layer-wise additive manufacturing process. A printing device may utilize suitable printing consumables, such as ink, toner, fluids or powders, or other raw materials for printing. In some examples, a printing device may be a three-dimensional (3D) printing device. An example of printing fluid is a water-based latex ink ejectable from a print head, such as a piezoelectric print head or a thermal inkjet print head. Other examples of print fluid may include dye-based color inks, pigment-based inks, solvents, gloss enhancers, etc.

Various examples described below relate to coupling a buffer reservoir to a pressure system in case of a leak of print fluid from a print fluid container. A pressure system is separate from the print fluid delivery system and the pressure system provides fluid pressure on the print fluid cartridge to enable print fluid delivery from the print fluid cartridge. However, if a leak in the print fluid cartridge occurs, print fluid may mix with the pressure fluid (e.g., air) and enter the pressure system. In some cases, such as after depressurization, the print fluid may flow to multiple tubes and possibly into the interface to the fluid movement device (e.g., air pump) or interfaces connecting to other print fluid cartridges. This costly repair may be mitigated by modifying the pressure system to include a buffer reservoir which may, for example, limit the flow of ink in the pressure system components before a leak is detected and able to be repaired.

The terms "include," "have," and variations thereof, as used herein, mean the same as the term "comprise" or appropriate variation thereof. Furthermore, the term "based on," as used herein, means "based at least in part on." Thus, a feature that is described as based on some stimulus may be based only on the stimulus or a combination of stimuli including the stimulus. Furthermore, the term "interface," as used herein, refers to a first surface defining a point of interconnection of a first component to accept a second surface of another component. In the examples herein, a component fluidly interfaces with another component by connecting surfaces of components to allow fluid to move from a channel or chamber of a first component to a channel or chamber of a second component.

Figure 1:
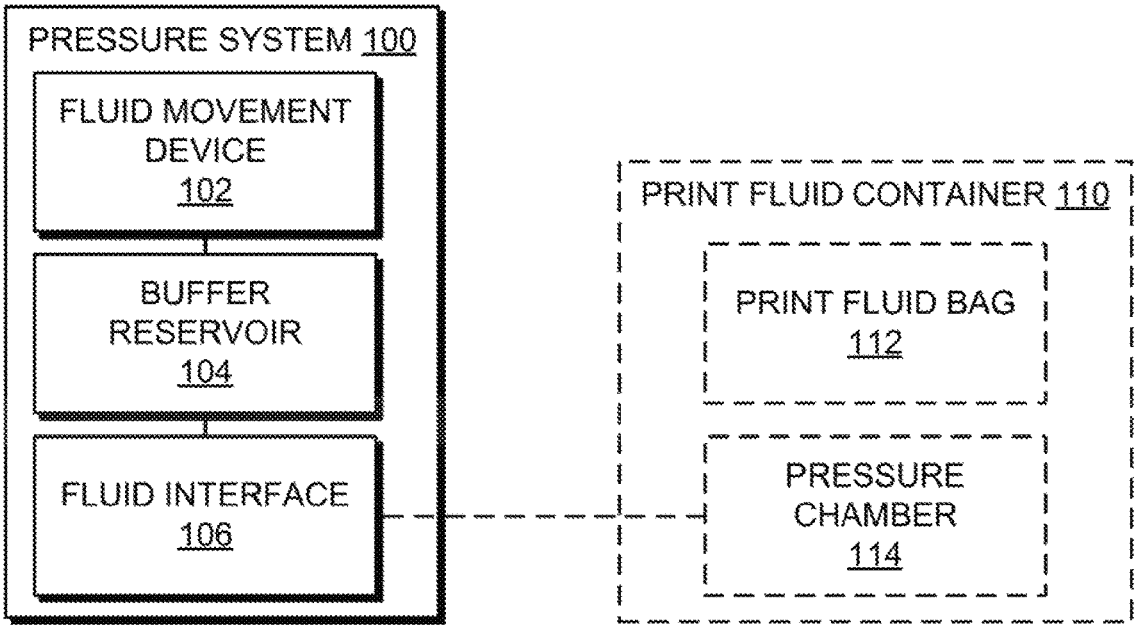
FIG. 1 is a block diagram of an example pressure system.
Figure 2:
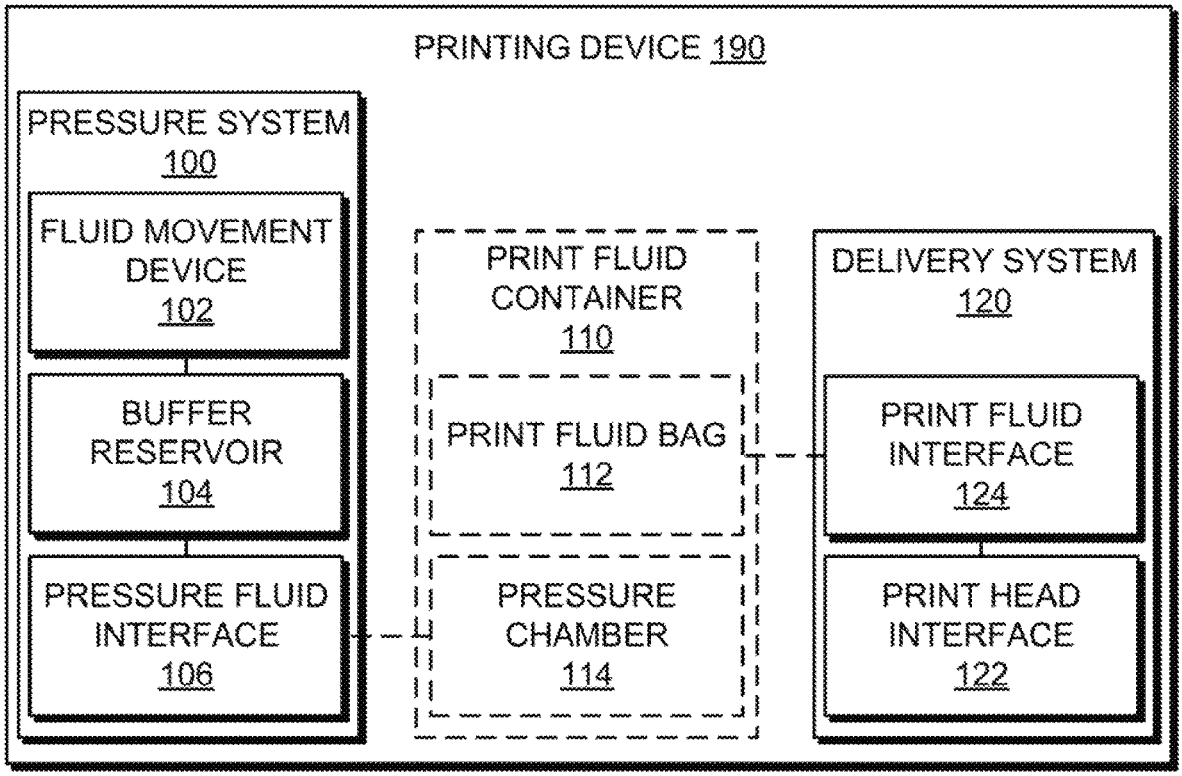
FIGS. 2 and 3 are block diagrams depicting example printing devices with an example pressure system and an example delivery system.
Figure 3:
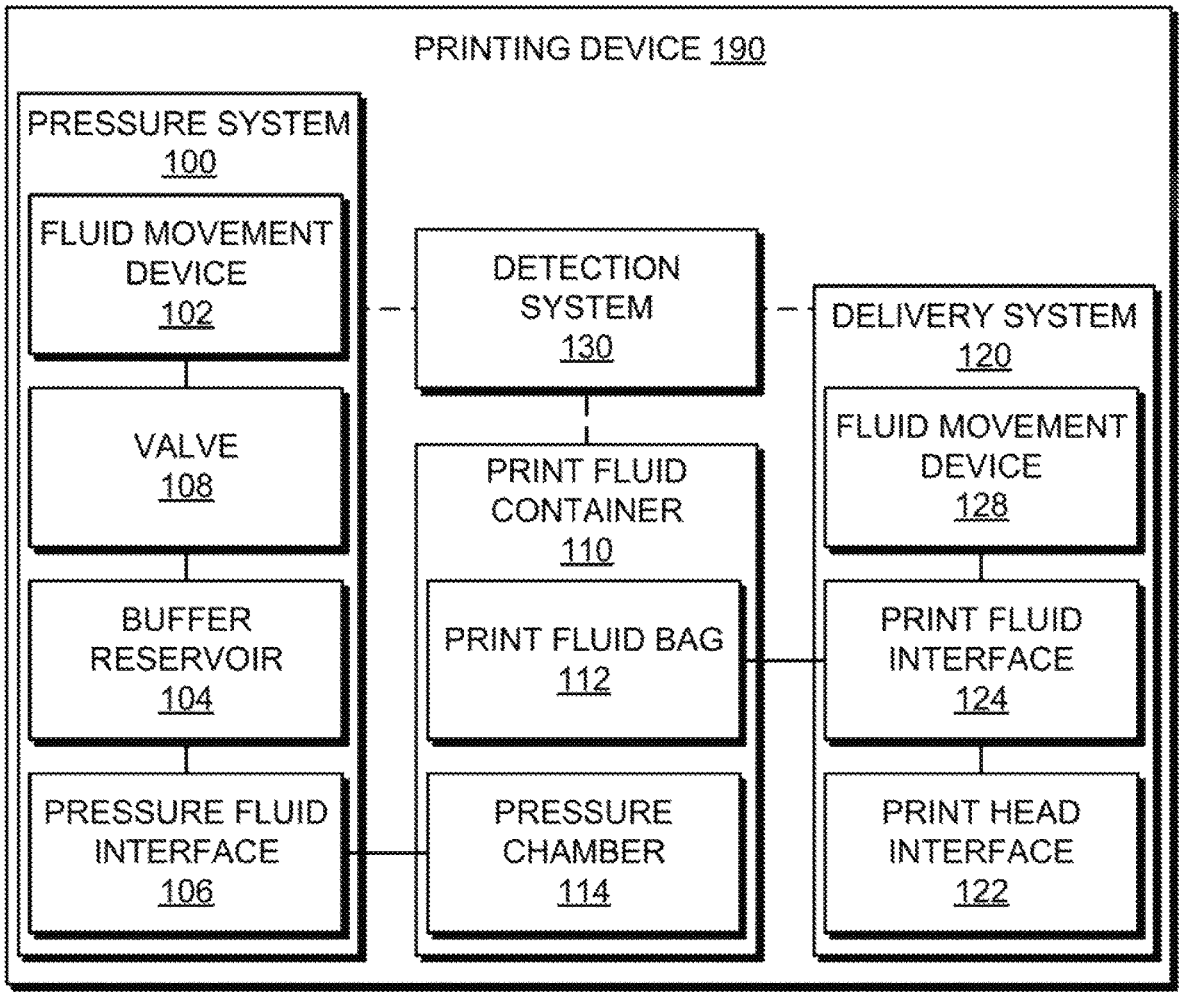

FIG. 1 is a block diagram of an example pressure system 100. The example pressure system 100 of FIG. 1 generally includes a fluid movement device 102, a buffer reservoir 104, and a fluid interface 106. In general, the fluid movement device 102 pressurizes the passages and chambers that are fluidly coupled to the fluid movement device, such as the buffer reservoir 104 and a print fluid cartridge coupled 110 to the fluid interface 106. The fluid interface 106 is coupleable to a pressurizable section of the print fluid cartridge 110. As depicted in FIGS. 1 and 2, a print fluid container 110 may be coupled to the fluid interface 106 where the print fluid container 110 contains a print fluid section (e.g., print fluid in a collapsible print fluid bag) and a pressure section. A print fluid container 110 may be an ink cartridge, for example. In the examples of FIGS. 1-3, the print fluid section is shown and described as a print fluid bag 112, and the pressure section is shown and described as a pressure chamber 114. The pressure force applied to the pressure chamber 114 by the fluid movement device 102 applies force on the print fluid bag 112 to enable delivery of print fluid from the print fluid bag 112 by a print fluid delivery system, such as the delivery system 120 of FIG. 2. The dotted lines of FIGS. 1 and 2 represent components that may not be coupled to the pressure system. For example, a print fluid container 110 may be removeable from the printing device 190 for storing the printing device 190 or to replace the print fluid container 110.

FIGS. 2 and 3 are block diagrams depicting example printing devices 190 with an example pressure system 100 and an example delivery system 120. Referring to FIG. 2, the pressure chamber 114 is coupled to the pressure system 100 via the pressure fluid interface 106 and the print fluid bag 112 is coupled to the print fluid delivery system 120 via the print fluid interface 124. The delivery system 120 of FIG. 2 may include a print head interface 122 that couples to a print head assembly to deliver print fluid from the print fluid bag 112 to a print zone. The print head interface 122 may directly couple the print fluid interface 124 to the print head of the print head assembly or may indirectly couple the print fluid interface 124 to the print head assembly.

The print fluid interface 124 is separate and fluidly distinct from the pressure fluid interface 106. The print fluid interface 124 is to couple the print fluid bag 112 to the print fluid delivery system 120, and the pressure fluid interface 106 is to couple the pressure chamber 114 to the pressure system 100. As used herein, the phrase "fluidly distinct" describes the characteristic that, when operating appropriately under printing conditions, the fluid of a first system is kept separate from the fluid of a second system. Accordingly, the pressure system 100 is fluidly distinct from the delivery system 120 by physically separating the interfaces and tubing of systems 100 and 120. For example, the buffer reservoir 104 is not directly connected to the print fluid delivery system and does not allow print fluid to pass to the buffer reservoir under usual printing conditions.

A wall of the print fluid bag 112 in the print fluid container 110 is constructed to divide the print fluid and fluid in the pressure chamber 114 (discussed as pressure fluid herein), however, the wall may encounter a fault and leak print fluid. In that example, the pressure system 100 is constructed to be fluidly distinct from the delivery system 120, and the fault has allowed the fluids to move beyond the desired boundaries of the systems 100 and 120. For example, pressurized air may enter into the delivery system 120 and/or the print fluid may enter the air tubes of the pressure system 100. In that example, the misappropriated fluids may result in malfunctions or undesired operation of the printing device 190, which may result in a service call, such as component cleaning and/or replacement. Another example of fluidly distinct systems is shown in FIG. 3, where a fluid movement device 102 is used for the pressure system 100 and a separate fluid movement device 128 is used for the delivery system 120.

The buffer reservoir 104 is coupled between the fluid movement device 102 and the pressure fluid interface 106. The volume of the buffer reservoir 104 may allow for misappropriated print fluid to be retained. The buffer reservoir 104 may be mounted on a support structure of the printing device 190 and may be mounted above or below the components print fluid delivery system 120 depending on the size of the buffer reservoir 104. For example, a buffer reservoir 104 having a capacity that is less than a capacity of a print fluid bag 112 may be located (e.g., mounted) above the pressure fluid interface 106, above the print fluid interface 124, above a container receiving area, above the fluid movement device 102, and/or above the print fluid container 110. For another example, a buffer reservoir 104 having a capacity that is larger than a capacity of a print fluid bag 112 may be located below the pressure fluid interface 106, below the print fluid interface 124, below the fluid movement device 102, below a container receiving area, and/or below the print fluid container 110.

The fluid movement device 102 may be adjustable. For example, the fluid movement device 102 may have adjustable operation to change the amount of pressure provided by the fluid movement device 102 and/or change the pressure within the pressure chamber 114 and the force applied on the print fluid bag 112. For another example, the force applied on the print fluid bag 112 via the fluid movement device 102 may be dependent on a level of print fluid in the print fluid bag 112. In that example, an ink level sensor may relay the amount of ink in the print fluid bag 112 to a controller of the printing device 190 which may control the fluid movement device 102 to adjust to a predetermined amount of pressure based on a threshold ink level. An example fluid movement device 102 that pressurizes a fluid may be an air pump that pressurizes air within the buffer reservoir 104.

Referring to FIG. 3, a valve 108 may be coupled to the fluid movement device 102. The valve 108 may adjust the pressure force within the pressure system 100. For example, the print fluid bag 112 may be collapsible based on the applied force via the fluid movement device 102 and a valve setting (e.g., on or off). For another example, a valve coupled to the fluid movement device may be used to depressurize a first pressure chamber of the plurality of pressure chambers of the plurality of print fluid containers inserted into the container receiving area. The valve 108 may be adjusted to allow the pressure chamber 114 and/or the buffer reservoir 104 to depressurize to allow for replacement of a print fluid container or replacement of a component of the pressure system 100 affected by a print fluid leak.

As shown in the example of FIG. 3, the printing device 190 may include a print fluid detection system 130 to detect a leek from any print fluid bags connected to the printing device 190. For example, the print fluid detection system 130 may detect a leak in a first print fluid bag of a plurality of connected print fluid bags using a sensor coupled to a fluid passage or chamber. As indicated by the dotted lines of FIG. 3, the print fluid detection system 130 may be coupled to the pressure system 100, the print fluid container 110, and/or the print fluid delivery system 120. For example, the print fluid detection system 130 may comprises a sensor coupled to the buffer reservoir 104 to identify whether a threshold amount of liquid is in the buffer reservoir 104. The print fluid detection system 130 may include a combination of circuitry and executable instructions to identify that data from a sensor indicates the existence of print fluid (e.g., threshold amount) and generate a user-interface notification regarding the identification and possible service solutions.

Figure 4:
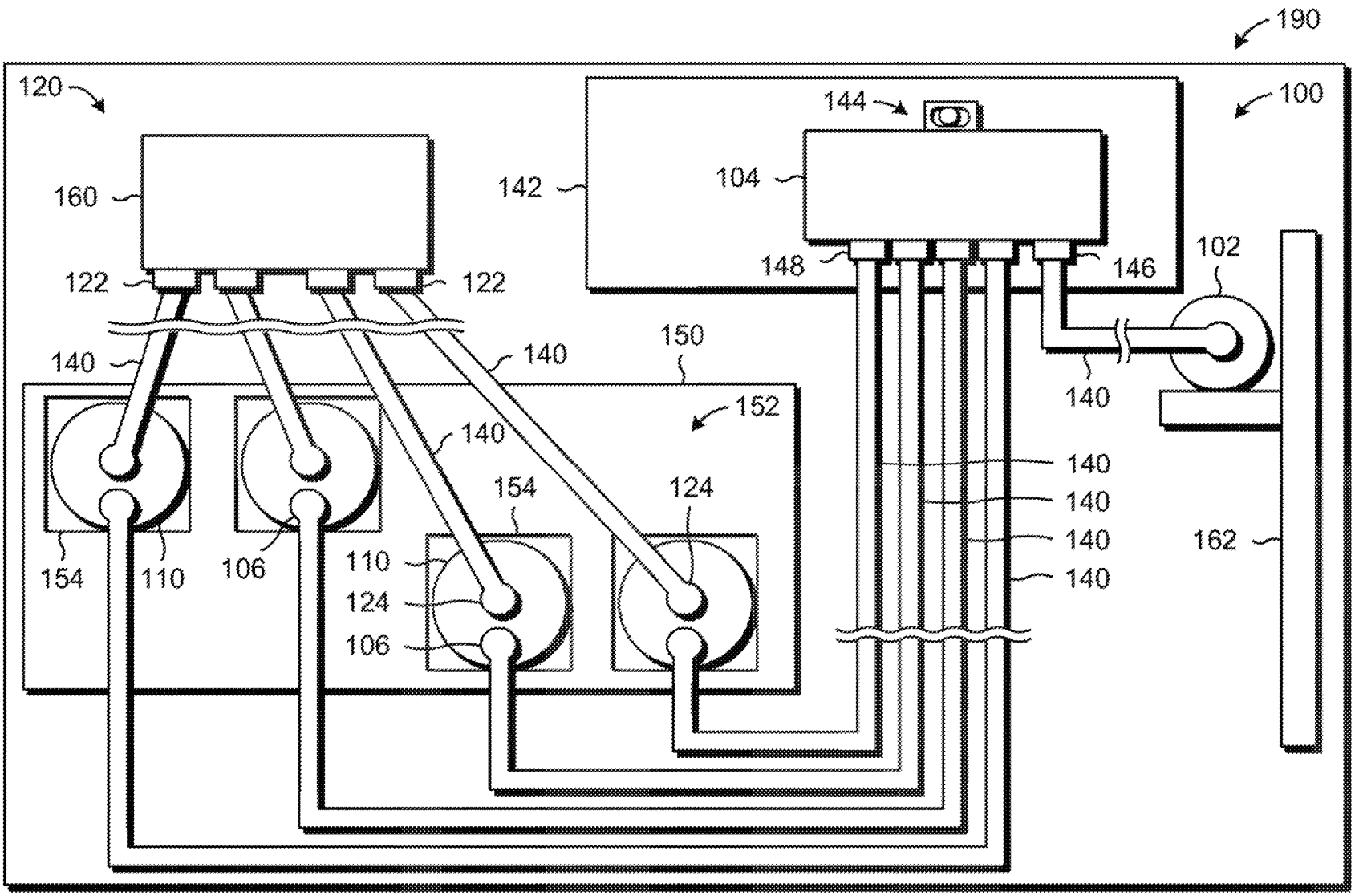
FIGS. 4 and 5 depict example environments in which various example pressure systems may be implemented.
Figure 5:
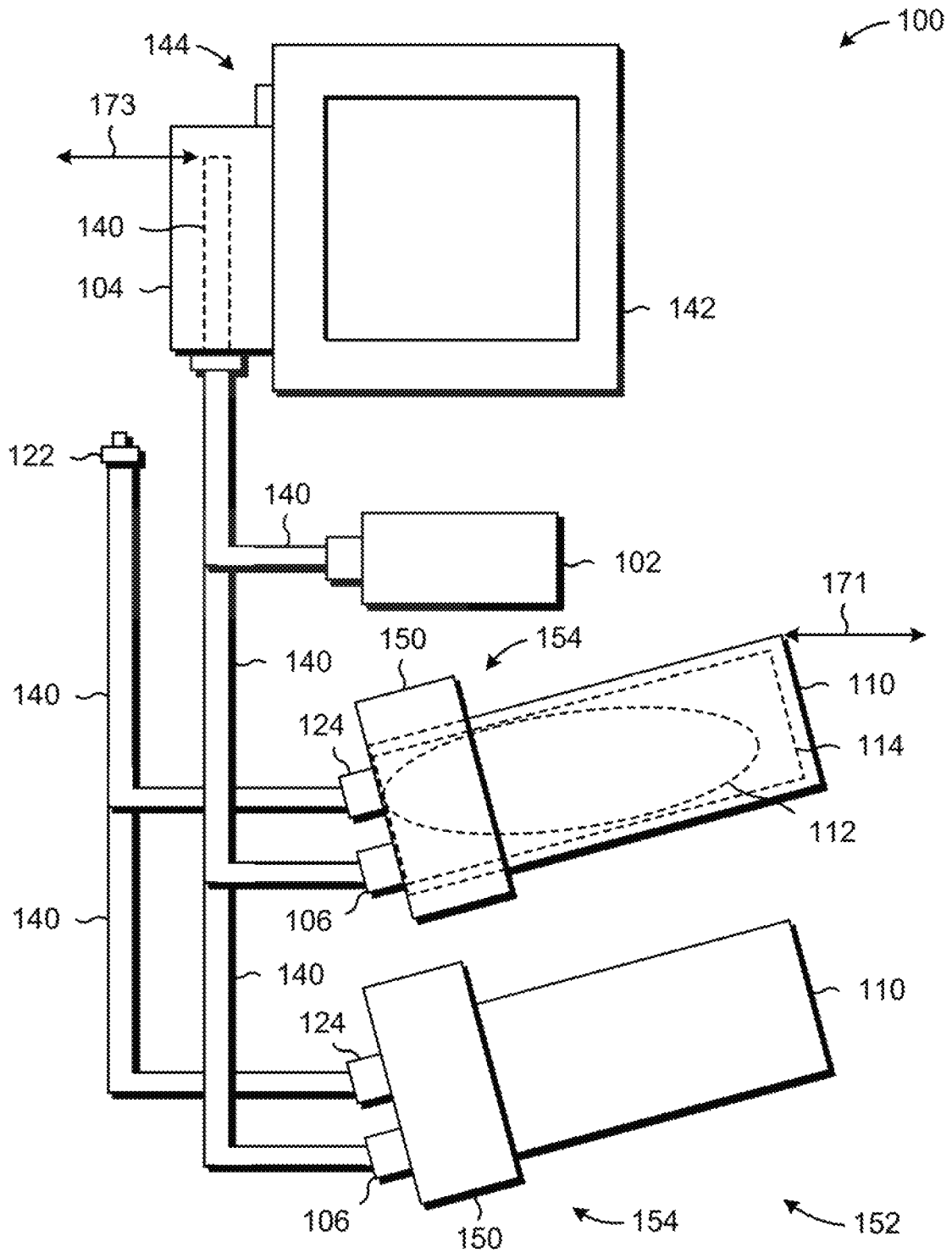

FIGS. 4 and 5 depict example environments in which various example pressure systems 100 may be implemented. Referring to FIG. 4, an example pressure system 100 may be implemented within a printing device 190. The pressure system 100 may include a fluid movement device 102, a buffer reservoir 104, a plurality of pressure fluid interfaces 106 to couple to a plurality of pressure chambers in a plurality of print fluid containers 110, and tubes 140 fluidly connecting the components of the pressure system 100. A support structure 142 defines (e.g., forms) a reservoir mounting area 144 to place the buffer reservoir 104. For example, a mounting interface may be placed on a carriage beam of the printing device 190 to mount the buffer reservoir 104 above the fluid movement device 102 and above the area 152 where a plurality of print fluid containers 110 are located. By mounting the buffer reservoir 104 on a carriage beam with reference to the scan axis above the container locations, the buffer reservoir 104 sits at a common point of the different supply containers.

The fluid movement device 102 may be mounted on a support structure 162. The buffer reservoir 104 may include a plurality of interfaces 146 and 148. For example, the buffer reservoir 104 of FIG. 4 includes an inlet 146 for receiving fluid from the fluid movement device 102 and outlets 148 for passing fluid to the pressure fluid interfaces 106. In that example, a tube 140 is coupled between the fluid movement device 102 and the buffer Inlet interface 146 on the buffer reservoir 104 and a plurality of tubes is coupled between the buffer outlet interfaces 148 and the pressure fluid interfaces 106. In this manner, the fluid movement device 102 is able to provide fluid at a pressurized amount to the buffer reservoir 104 and on to the individual pressure sections of the print fluid containers 110. The buffer reservoir 104 (and the other components of the pressure system 100) is fluidly distinct from the print fluid delivery system 120.

In the examples of FIGS. 4 and 5, tubes 140 are used to couple a plurality of print fluid bags of a plurality of print fluid containers 110 to a plurality of print head interfaces 122 coupled to a print head assembly 160. The plurality of print fluid containers 110 are able to connect to the print fluid interfaces 124 and the pressure fluid interface 106 at a plurality of print fluid insert locations 154 at a container receiving area 152. A support structure may define (e.g., form) the container receiving area 152 to allow for loading and unloading of the print fluid containers 110. The container receiving area 152 includes a plurality of container insert locations 154 defined by surfaces of the support structure 150. The container insert locations 154 may be defined so that print fluid containers 110 are insertable to attach the print fluid bag of the container 110 to the delivery system 120 and the pressure chamber of the container 110 to the pressure system 100. The pressure system 100 is coupled to the container receiving areas at the container pressure fluid interfaces 106 and the print fluid delivery system 120 is coupled to the container receiving area 152 at the container print fluid interfaces 124. In the examples of FIGS. 4 and 5, the container print fluid interfaces 124 are above the container pressure fluid Interfaces 106 at the insert locations 154 of the container receiving area 152. The container pressure fluid interfaces 106 and the container print fluid interfaces 124 are correlated by insert location (e.g., correlated by container). For example, the first tube of a plurality of tubes to the buffer reservoir interfaces 148 coupled at a first container pressure fluid interface 106 to a first pressure chamber of a container 110 is correlated with a second tube of a plurality of tubes to the print head interfaces 122 coupled at a first container print fluid interface 124 of the first print fluid bag of the same container 110. There may be multiple sets of container insert locations and pairs of interfaces at each insert location. For example, the container receiving area may include a first plurality of container insert locations above a second plurality of container insert locations, where each location includes a pair of interfaces including a container print fluid interface 124 and a container pressure fluid interface 106.

Referring to FIG. 5, a side view is shown of an example pressure system 100 including a buffer reservoir 104, a fluid movement device 102, and a plurality of print fluid containers 110 inserted into the container insert locations 154 and coupled to the pressure system 100 at interfaces 106. The dotted lines represent outlines of components within other components, such as tubes 140 within the buffer reservoir 104, the print fluid bag 112 within the print fluid container 110, and the pressure chamber 114 surrounding the print fluid bag 112.

As shown in FIG. 5, the buffer reservoir 104 is mounted on a support structure 142 (such as a carriage beam) at a mounting area 144 so that the buffer reservoir 104 is located above a horizontal plane 171 of a print fluid container 110 of the plurality of print fluid containers inserted into a first container insert location 154 of the first plurality of container insert locations of the container receiving area 152. With the buffer reservoir 104 set above the level of print fluid in the print fluid container 110, the buffer reservoir 104 (and the tube 140 leading from the container to the buffer reservoir 104) may retain the print fluid leaked into pressure system 100 and prevent an amount of print fluid from flowing to other tubes or components of the pressure system 100, for example.

The height of the buffer reservoir 104 may be described herein with reference to the height of tube inlets within the buffer reservoir 104, which may designate a maximum accumulation level before print fluid may enter other tubes of the pressure system 100. To assist containment of leaked print fluid in the buffer reservoir 104 and prevent further contamination of other components of the printing device 190, the pressure fluid inlets of the tubes 140 may be placed at a horizontal plane 173 at the upper part of the buffer reservoir 104 (e.g., above the midpoint of the height of the buffer reservoir 104). For example, the plurality of tubes 140 from the container pressure fluid interfaces 106 may be coupled to the buffer reservoir 104 such that the plurality of inlets of the plurality of tubes 140 are at a top of the buffer reservoir 104 (i.e., near the surface of the celling of the buffer reservoir). In this manner, print fluid going backwards through the tubes 140 of the pressure system 100 from leaking print fluid bags 112 may exit the inlet of the tubes 140 into the buffer reservoir 104 and accumulate at the bottom of the buffer reservoir 104 and may, for example, hinder print fluid from going from the buffer reservoir 104 into another tube 140 in the buffer reservoir 104 (until the print fluid has accumulated to the height of the inlet of the tubes 140). Thus, the buffer reservoir 104 may be adapted to have a capacity to retain a desired amount of fluid, such as a capacity to hold the print fluid anticipated as being allowed through a leak before the leak is detected and serviced. In this manner, the buffer reservoir 104 may have be a size to retain the amount of fluid available in a print fluid container 110 if a full bag happens to leak, a size to retain the amount of the capacity of multiple print fluid bags if a multiple full bags happen to leak, or a size to retain less than the amount of fluid in a full print fluid container 110, for example.

Some components may be described as having a number of components in an example. Other examples may utilize a different number of components, a different size of component, or a component with a different degree of functionality. For example, a single fluid movement device 102 is shown and described in FIGS. 1-5 and in other examples a second fluid movement device may be coupled to and used in conjunction with (or in the same manner as) the first fluid movement device 102. The components of the printing device 190, the pressure system 100, the print fluid container 110, and the delivery system 120, are shown in the FIGS. 1-5 as blocks or other representations of components and should not be limited to size, shape, orientation, as depicted in the drawings unless described otherwise herein. Also, the components of a system may complete or assist completion of operations performed in describing another component. For example, a tube may be part of a fluid interface or a valve may be part of the fluid movement device rather than separate components.

All of the features disclosed in this specification (including any accompanying claims, abstract and drawings), and/or all of the elements of any method or process so disclosed, may be combined in any combination, except combinations where at least some of such features and/or elements are mutually exclusive.

The present description has been shown and described with reference to the foregoing examples. It is understood, however, that other forms, details, and examples may be made without departing from the spirit and scope of the following claims. The use of the words "first," "second," or related terms in the claims are not used to limit the claim elements to an order or location, but are merely used to distinguish separate claim elements.

What is claimed is:

1. A pressure system comprising:

a fluid movement device;

a buffer reservoir coupled to the fluid movement device, the fluid movement device to pressurize the buffer reservoir; and a first fluid interface coupled to the buffer reservoir, the first fluid interface to couple to a pressurizable chamber that applies force on a print fluid bag of a print fluid container to enable delivery of print fluid from the print fluid bag by a print fluid delivery system, wherein the first fluid interface is separate from a second interface to couple the print fluid bag to the print fluid delivery system, and wherein the buffer reservoir is located above the print fluid bag, the first fluid interface and the second fluid interface.

2. The system of claim 1, further comprising:

a valve coupled to the fluid movement device; and the print fluid bag is collapsible based on the applied force via the fluid movement device and a first valve setting.

3. The system of claim 2, wherein:

the fluid movement device is adjustable; and the force applied on the print fluid bag via the fluid movement device is dependent on a level of print fluid in the print fluid bag.

4. The system of claim 1, wherein:

a capacity of the buffer reservoir is less than a capacity of the print fluid bag.

5. The system of claim 1 comprising:

a first tube coupled between the first fluid interface and a third fluid interface on the buffer reservoir, the third fluid interface device being a buffer outlet; and a second tube coupled between a fourth fluid interface on the buffer reservoir and the fluid movement device, the fourth fluid interface being a buffer inlet.

6. The system of claim 1, further comprising:

a carriage beam located above the fluid movement device, wherein the buffer reservoir is mounted on the carriage beam.

7. The system of claim 1, wherein the buffer reservoir has a size to retain a full amount of the print fluid from the print fluid bag.

8. The system of claim 1, wherein the buffer reservoir is to retain leaked print fluid from the print fluid bag fluid in response to a leak in the print fluid bag and to prevent the leaked print fluid from flowing to other components of the pressure system.

9. A printing device comprising:

a print fluid delivery system comprising:

a print head interface coupled to a print head assembly; and a container print fluid interface to couple to a print fluid section of a print fluid container comprising a print fluid bag; and a pressure system fluidly distinct from the print fluid delivery system, the pressure system comprising:

a fluid movement device;

a buffer reservoir coupled to the fluid movement device; and a container pressure fluid interface coupled to the buffer reservoir, the container pressure fluid interface to couple to a pressure chamber section of the print fluid container, wherein the buffer reservoir is mounted above the print fluid bag, the container pressure fluid interface and the fluid movement device.

10. The device of claim 9, further comprising:

a first support structure defining a container receiving area, wherein:

the buffer reservoir has a capacity larger than a print fluid bag, the print fluid section comprising the print fluid bag.

11. The device of claim 9, further comprising:

a first support structure defining a container receiving area; and a second support structure defining a carriage beam, wherein:

the pressure system is coupled to the container receiving area at the container pressure fluid interface; and the buffer reservoir is mounted on the second support structure above the container receiving area.

12. The device of claim 11, wherein:

the print fluid delivery system is coupled to the container receiving area at the container print fluid interface; and the container print fluid interface is above the container pressure fluid interface at the container receiving area.

13. A printing device comprising:

a first support structure defining a container receiving area;

a second support structure defining a reservoir mounting area;

a print fluid delivery system comprising a first plurality of tubes connectable to a plurality of print fluid bags in a plurality of print fluid containers at the container receiving area; and a pressure system comprising:

a buffer reservoir mounted at the reservoir mounting area, the buffer reservoir fluidly distinct from the print fluid delivery system, the buffer reservoir mounted above the plurality of print fluid bags in the plurality of print fluid containers;

a fluid movement device coupled to the buffer reservoir; and a second plurality of tubes coupled to the buffer reservoir, the second plurality of tubes connectable to a plurality of pressure chambers in the plurality of print fluid containers at the container receiving area.

14. The device of claim 13, wherein:

the second support structure comprises a carriage beam;

the container receiving area includes a first plurality of container insert locations above a second plurality of container insert locations; and the buffer reservoir is located above a horizontal plane of a first print fluid container of the plurality of print fluid containers inserted into a first container insert location of the first plurality of container insert locations.

15. The device of claim 13, further comprising:

a valve coupled to the fluid movement device to depressurize a first pressure chamber of the plurality of pressure chambers of the plurality of print fluid containers inserted into the container receiving area.

16. The device of claim 13, further comprising:

a print fluid detection system to detect a leak of a first print fluid bag of the plurality of print fluid bags, wherein:

the second plurality of tubes is coupled to the buffer reservoir such that a plurality of inlets of the second plurality of tubes is at a top of the buffer reservoir, and the buffer reservoir has a capacity to hold the print fluid allowed through the leak to a first tube of the second plurality of tubes, the first tube of the second plurality of tubes coupled to a first pressure chamber of the plurality of pressure chambers correlated with the first print fluid bag.

17. The device of claim 16, wherein the print fluid detection system is coupled to the buffer reservoir.

18. The device of claim 13, wherein the second plurality of tubes extend through a bottom of the buffer reservoir to a plurality of inlets located above a midpoint height of the buffer reservoir.

19. The device of claim 13, wherein the second plurality of tubes are coupled to the buffer reservoir at a plurality of inlets placed at a horizontal plane at an upper part of the buffer reservoir.

* * * * *